United States Patent [19]

Roche et al.

[11] Patent Number: 4,751,435

[45] Date of Patent: Jun. 14, 1988

[54] DUAL CATHODE BEAM MODE FLUORESCENT LAMP WITH CAPACITIVE BALLAST

[75] Inventors: William J. Roche, Merrimac; Joseph M. Proud, Wellesley Hills; A. Bowman Budinger, Westford, all of Mass.

[73] Assignees: GTE Laboratories Incorporated; GTE Products Corporation, both of Waltham, Mass.

[21] Appl. No.: 681,012

[22] Filed: Dec. 13, 1984

[51] Int. Cl.[4] ..... H05B 41/14

[52] U.S. Cl. ..... 315/235; 315/56; 315/260; 313/310

[58] Field of Search ..... 361/377; 315/227 R, 315/239, 235, 241 R, 56, 247, 248

[56] References Cited

U.S. PATENT DOCUMENTS

| | | | |
|---|---|---|---|
| 3,361,930 | 1/1968 | Blank | 315/241 R |
| 3,943,403 | 3/1976 | Haugsjaa et al. | 315/248 |
| 4,408,141 | 10/1983 | Byszewski et al. | 315/56 |
| 4,412,152 | 10/1983 | Barakitis et al. | 315/73 |
| 4,413,204 | 11/1983 | Byszewski et al. | 313/491 |
| 4,427,955 | 1/1984 | Roberts | 315/239 |
| 4,450,380 | 5/1984 | Proud et al. | 313/485 |
| 4,494,046 | 1/1985 | Budinger et al. | 315/260 |
| 4,516,057 | 5/1985 | Proud et al. | 315/260 |
| 4,518,897 | 5/1985 | Proud et al. | 315/260 |
| 4,521,718 | 6/1985 | Byszewski | 315/99 |

FOREIGN PATENT DOCUMENTS

| | | |
|---|---|---|
| 0087962 | 9/1983 | European Pat. Off. . |
| 202480 | 9/1983 | Fed. Rep. of Germany . |
| 2092831 | 2/1981 | United Kingdom . |

*Primary Examiner*—David K. Moore
*Assistant Examiner*—Theodore Salindong
*Attorney, Agent, or Firm*—Hamilton, Brook, Smith & Reynolds

[57] ABSTRACT

An improvement in dual beam mode fluorescent lamps in which a capacitive ballast is provided integral with the lamp structure in the form of a cylindrical laminate of metal and insulator coaxial to the lamp's major axis.

9 Claims, 1 Drawing Sheet

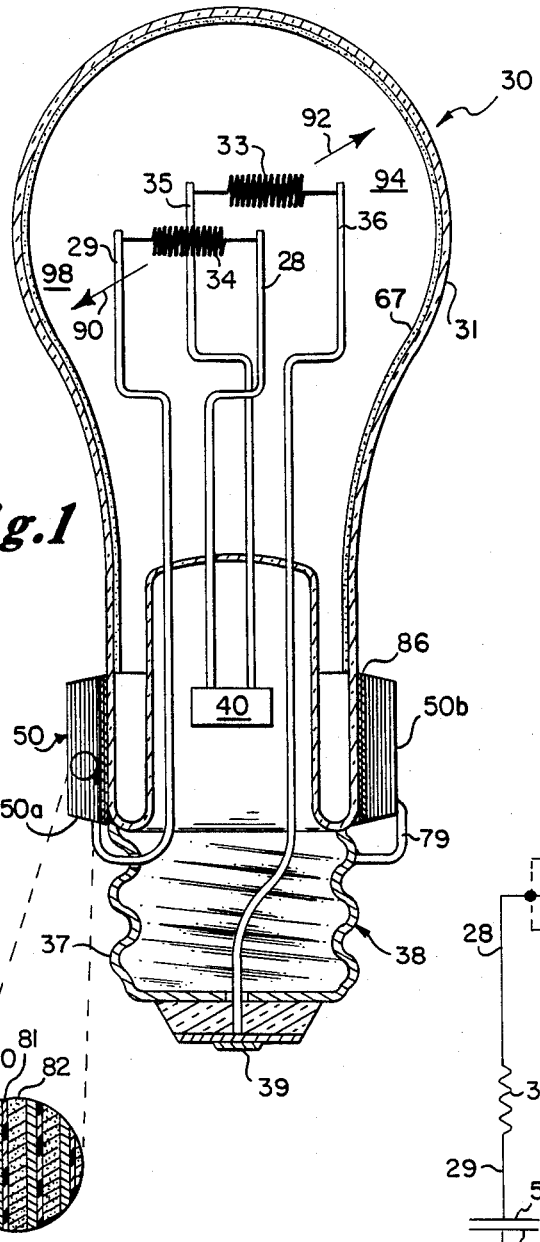
Fig.1
Fig.3
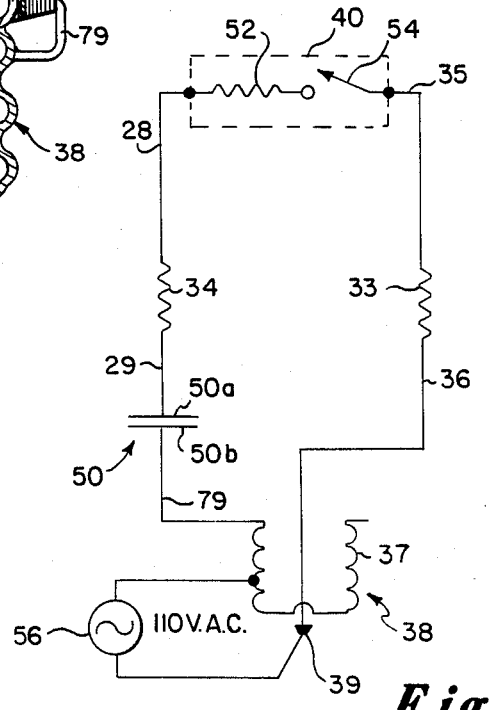
Fig.2

DUAL CATHODE BEAM MODE FLUORESCENT LAMP WITH CAPACITIVE BALLAST

DESCRIPTION

1. Cross Reference to Related Applications

The present invention is related to U.S. Pat. Nos. 4,408,141, 4,413,204 and 4,450,380, assigned to the same assignee. The present invention is also related to U.S. patent application Ser. Nos. 337,047, now abandoned filed Jan. 4, 1982, 336,971, now U.S. Pat. No. 4,518,897, filed Jan. 4, 1982 and 337,048, now U.S. Pat. No. 4,516,057, filed Jan. 4, 1982, all assigned to the same assignee.

2. Technical Field

The present invention pertains to beam mode discharge fluorescent lamps and more particularly to a method and apparatus for incorporating an integral capacitive ballast in such lamp.

3. Background Art

U.S. Pat. No. 4,408,141, for a "Beam Mode Fluorescent Lamp", discloses an A.C. powered beam mode fluorescent lamp with two electrodes. In one-half of the A.C. cycle, a first element is positively biased with respect to a second element. The second element functions as a thermionic cathode and emits electrons while the first electrode functions as an accelerating electrode to accelerate the emitted electrons forming a beam of electrons which enter a first drift region. In the remaining half of the cycle, the polarity of the voltage on the electrodes is reversed and the first electrode emits electrons which are accelerated by the second electrode and form a beam of electrons which enter a second drift region.

The electrodes are disposed within a light transmitting envelope enclosing a fill material, which emits ultraviolet radiation upon excitation. A phosphor coating on an inner surface of the envelope emits visible light upon absorption of the emitted ultraviolet radiation.

The first and second electron beams alternately drift through two drift regions within the lamp envelope after passing their respective accelerating electrodes on alternate half cycles of the A.C. voltage. Electrons in each electron beam collide with atoms of the fill material in the corresponding drift region, thereby causing excitation of a portion of the fill material atoms and emission of ultraviolet radiation and causing ionization of respective portions of the fill material atoms thereby yielding secondary electrons. These secondary electrons cause further emissions of ultraviolet radiation.

The dual-cathode beam mode fluorescent lamp thus far described has a positive current voltage characteristic and therefore requires no ballast when driven at relatively low A.C. voltage levels of about 20 Vac.

When operated at standard U.S. line voltage of 110 Volts ac, the line voltage is usually reduced by inserting a step-down transformer between the line voltage source and the cathode leads, as in the power source 40 referenced in the '141 patent.

Such transformers are relatively expensive and bulky and cannot readily be incorporated into the lamp structure as an integral unit.

DISCLOSURE OF THE INVENTION

In accordance with the present invention, a capacitive ballast for a dual beam-mode discharge lamp is provided integral with the lamp structure. The capacitive ballast is preferably in the form of a cylindrical capacitor mounted above and coaxial to the screw-in base of the lamp and the major lamp axis. The capacitor is formed of a laminate of thin metallized mylar wrapped around an insulated cylindrical coil. The dual beam-mode lamp comprises a pair of filaments. One side of each filament is electrically connected across a preheat normally closed thermostat starter switch and resistor. The remaining side of one filament is coupled to the center contact of the lamp base. The remaining side of the other filament is coupled to one side of the ballast capacitor. The other side of the capacitor is coupled to the outer screw contact of the lamp base to complete the circuit.

In operation, the screw-in lamp base is connected to a 110 Vac power source. A discharge is established in the lamp by closing the switch to allow current to flow through the filaments. Once thermionic emitting temperature is reached, the switch is opened, and discharge occurs between the two filaments. Filament temperature is subsequently maintained by ion and electron bombardment. The capacitor acts as a high Q voltage divider to reduce the impressed voltage across the lamp. The vector difference between the line voltage and the lamp operating voltage is the voltage impressed across the series capacitor. The capacitor structure is relatively small and compact and can be provided coaxial to the lamp envelope thus eliminating the bulky transformer required in the '141 patent. Also, the capacitor is a relatively high Q device with resultant low power dissipation.

BRIEF DESCRIPTION OF THE DRAWINGS

FIG. 1 is a perspective view of a schematic diagram of a dual cathode beam mode fluorescent lamp embodying the present invention.

FIG. 2 is a schematic diagram of the dual cathode beam mode fluorescent lamp structure of FIG. 1; showing the ballast capacitor connections.

FIG. 3 is an enlarged view of a cross-section of capacitor 50 of FIG. 1.

BEST MODE OF CARRYING OUT THE INVENTION

Referring to FIGS. 1 and 2 wherein a beam mode fluorescent lamp 30 according to the present invention is shown; a vacuum type lamp envelope 31 made of a light transmitting substance, such as glass, encloses a discharge volume. The discharge volume contains a fill material which emits ultraviolet radiation upon excitation. A typical fill material includes mercury and a noble gas or mixtures of noble gases. A suitable noble gas is neon. The inner surface of the lamp envelope 31 has a phosphor coating 67 which emits visible light upon absorption of ultraviolet radiation. Also enclosed within the discharge volume of the envelope 31, is a pair of electrodes 33 and 34. These electrodes 33 and 34 function alternately as an accelerating electrode and cathode, depending on the instantaneous polarity of the A.C. voltage. At any given time one electrode is an accelerating electrode and the other is a cathode.

Electrode 33 is connected between conductors 35 and 36 and electrode 34 is connected between conductors 28 and 29. Each of the conductors is about the same height so that the two electrodes 33 and 34 lie in about the same horizontal plane. The electrodes 33 and 34 are disposed adjacent and parallel to each other and spaced approximately one centimeter apart.

Conductor 29 extends through a re-entrant portion of lamp envelope 31 to one side (50*a*) of ballast capacitor 50. The other side of electrode 34 is coupled to resistor 52 in the start circuit of enclosure 40 via support lead 28. Electrode 33 is connected on one side, via conductor 35, to pre-heat switch 54 in enclosure 40, and on the remaining side to the center contact 39 of base 38 via conductor 36 which extends through the re-entrant portion of lamp envelope 31. Lastly, conductor 79 connects the remaining side 50*b* of capacitor 50 to the threaded contact portion 37 of lamp base 38.

Conductors 28, 29, 35 and 36 provide for the above-mentioned connections through the envelope 31 in a vacuum tight seal, and also provide support for electrodes 33 and 34. Electrodes 33 and 34 are typically two volt thermionic type filament electrodes.

The lamp 30 further includes a metal base 38 which is of a conventional type affixed to lamp envelope 31 by conventional means, such as epoxy. Base 38 is suitable for inserting into an incandescent lamp socket.

Capacitor 50, as may be seen in the enlarged cross-section of FIG. 3, comprises a cylindrical capacitor formed of a thin metallized plastic film, such as copper 80 on a plastic dielectric such as MYLAR 81, wrapped around an insulated cylindrical core formed of bakelite 82 or other like insulating material. The capacitor 50 is affixed to cylindrical member 86 which, in turn, is located coaxial to the major axis of the lamp and around the re-entrant portion of the lamp envelope. Member 86 is affixed at one end to base 38 and at the other end to lamp envelope 31, such as by epoxy or other well-known glass-to-metal bonding means. Thus, capacitor 50 is located in a compact portion wherein minimum blockage of light from the lamp occurs.

Referring to FIGS. 1 and 2, in operation the circuit is activated by switching the lamp on whereby an A.C. voltage 56 is applied across the center base contact 39 and the screw-in outer contact 37 of base 38. The center base contact is coupled to electrode 33 via conductor 36. Contact 37 is coupled to electrode 34 through conductor 79, capacitor 50 and conductor 29. Capacitor 50 acts as a voltage reducer and generates a voltage proportional to the quantity of charge stored in it. Preferably, for a 110 Vac source, capacitor 50 has a capacitance of 20 microfarads which is sufficient to deliver an RMS current of 1 ampere for a 20 watt light source. On the positive first half cycle of the A.C. voltage, electrode 33 will be at a positive polarity with respect to electrode 34. As a result, electrode 34 will function as a thermionic cathode to emit electrons, thereby forming an electron beam as shown by arrow 92. Electrode 33 will function as an accelerating electrode to accelerate the electron beam into a first drift region 94.

On the next alternate half cycle of the A.C. voltage, electrode 34 will be positive with respect to electrode 33. Then, electrode 33 will function as a thermionic cathode to emit electrons forming a second electron beam 90 as a result. Electrode 34 will operate as an accelerating electrode and accelerate the formed electron beam into a corresponding second drift region 98.

The two drift regions 94 and 98 are located within the envelope 31 and extend in the direction of electron beam flow indicated, after passing their respective anodes on alternate half cycles of the A.C. voltage. Electrons in each region collide with atoms of the fill material, thereby causing excitation of a portion of the fill material atoms and emission of ultraviolet radiation and causing ionization of respective portions of the fill material atoms thereby yielding secondary electrons. These secondary electrons cause further emissions of ultraviolet radiation.

The high Q ballast capacitor 50 used in the invention for ballasting dissipates virtually no power unlike typical resistor ballasts. A capacitive ballast does not limit the instantaneous current, but generates a voltage proportional to the total quantity of charge stored in the capacitor. The reignition discontinuity found in the voltage of the typical fluorescent lamp, precludes the use of a capacitor alone as a ballast. The excessively high peak currents generated in this fluorescent type of lamp with a capacitive ballast are damaging to cathode life. However, because the dual cathode beam mode lamp exhibits no reignition discontinuity, it is thus ideally suited for capacitive ballasting.

The current crest factor (ratio of peak to RMS current) should ideally be as low as possible. This is because high peak currents are damaging to cathodes and can result in shorter lamp life. Unlike the typical fluorescent lamp, current crest factor remains low in a beam-mode discharge lamp when capacitively ballasted.

EQUIVALENTS

Although a preferred embodiment of the invention has been illustrated, and that form described in detail, it will be readily apparent to those skilled in the art that various modifications may be made therein, without departing from the spirit of the invention or from the scope of the appended claims.

What is claimed is:

1. A dual beam mode fluorescent lamp having a pair of closely spaced thermionic electrodes adapted to be energized by a current from a source of low frequency A.C. voltage and disposed within a light transmitting envelope coated with material which emits light when excited by ultraviolet radiation, said envelope enclosing a fill material which emits ultraviolet radiation when excited by electrons and further comprising:

(a) a lamp socket attached to the base of said envelope and having a center contact and an outer contact adapted to couple said low frequency A.C. voltage across said center and outer contact;

(b) ballast capacitor means coupled in series between one end of the first of said pair of electrodes and said outer contact as the sole impedance means for reducing the current passed through said electrdoes while maintaining a low ratio of peak of RMS current;

(c) a start circuit connected across the remaining end of the first electrode and one end of the second of said pair of electrodes;

(d) coupling means for connecting the remaining end of said second electrode to the center contact of said socket.

2. The lamp of claim 1 wherein the start circuit comprises a resistor in series with a thermionic switch.

3. The lamp of claim 1 having an overall longitudinal length extending along a major axis of said lamp and wherein the capacitor is a cylindrical laminate of metallized film and insulator disposed coaxial to said lamp's major axis such that the overall lamp length is not extended by inclusion of said ballast.

4. A dual cathode beam mode fluorescent lamp having first and second thermionic electrodes and a major axis adapted to be energized by current passed through said electrodes from a low frequency A.C. voltage power source comprising:

(a) a light transmitting envelope enclosing a fill material which emits ultraviolet radiation upon excitation;

(b) a high Q ballast capacitor adjacent said envelope providing the sole impedance means for reducing the current applied to said electrodes from said source while maintaining a low ratio of peak to RMS current, said capacitor having first and second sides;

(c) first and second power source contacts;

(d) a phosphor coating, which emits visible light upon absorption of ultraviolet radiation, on an inner surface of said envelope;

(e) a start circuit comprising a resistor and thermionic switch in series connection external to said envelope;

(f) first and second thermionic electrodes closely spaced apart from each other, each of said electrodes located within said envelope and each having first and second sides;

(g) first means for connecting the first ends of the first electrodes to said first source contact;

(h) second means for connecting the first ends of the second electrodes to the first side of the capacitor;

(i) third means for connecting the second side of the capacitor to said power source second contact; and (j) fourth and fifth means for connecting the respective second sides of the first and second electrodes across the start circuit.

5. A dual cathode beam mode fluorescent lamp as claimed in claim 4, wherein said capacitor is cylindrical in form and disposed coaxial to the major axis of the lamp envelope.

6. A dual cathode beam mode fluorescent lamp as claimed in claim 5 wherein the capacitor is a laminate of a metallized film and an insulator.

7. A dual cathode beam mode fluorescent lamp having first and second thermionic electrodes adapted to be energized by current generated by low frequency A.C. voltage from a power source comprising:

(a) a light transmitting lamp envelope having a first portion enclosing a fill material which emits ultraviolet radiation upon excitation and a re-entrant portion;

(b) a cylindrical high Q ballast capacitor adjacent said envelope mounted on said re-entrant portion coaxial to the lamp envelope providing the sole impedance means for reducing the current through the thermionic electrodes while maintaining a low ratio of peak to RMS current, said capacitor having first and second sides;

(c) first and second power source contacts;

(d) a phosphor coating, which emits visible light upon absorption of ultraviolet radiation, on an inner surface of the first portion of said envelope;

(e) a start circuit;

(f) each of said first and second thermionic electrodes located within said first portion of said envelope and closely spaced apart from each other and each having first and second ends;

(g) first means for connecting the first ends of the first electrodes to said first source contact through the re-entrant portion of the envelope;

(h) second means for connecting the first end of the second electrodes to the first side of the capacitor through the re-entrant portion of the envelope;

(i) third means for connecting the second side of the capacitor to said power source second contact through the re-entrant portion of the envelope; and (j) fourth and fifth means for connecting the respective second sides of the first and second electrodes across the start circuit through the re-entrant portion of the envelope.

8. A dual cathode beam mode fluorescent lamp as claimed in claim 7 wherein the capacitor is a laminate of a metallized film and an insulator.

9. A lamp as in claim 7 wherein the start circuit comprises a series connected resistor and thermionic switch.

* * * * *

UNITED STATES PATENT AND TRADEMARK OFFICE

CERTIFICATE OF CORRECTION

PATENT NO. : 4,751,435

DATED : June 14, 1988

INVENTOR(S) : Roche et al.

It is certified that error appears in the above—identified patent and that said Letters Patent is hereby corrected as shown below:

Column 4, line 51, "electrdoes" should be spelled ---electrodes---.

Column 4, line 51, after "peak", the word "of" should be changed to ---to---.

Signed and Sealed this

First Day of November, 1988

*Attest:*

DONALD J. QUIGG

*Attesting Officer*

*Commissioner of Patents and Trademarks*